US006585487B2

(12) United States Patent
Nodd et al.

(10) Patent No.: US 6,585,487 B2
(45) Date of Patent: Jul. 1, 2003

(54) METHOD FOR DECORATING CEILING FANS

(76) Inventors: Zina Nodd, 1509 Sawada Dr., Mobile, AL (US) 36618; Beck Nodd, Sr., 1509 Sawada Dr., Mobile, AL (US) 36618

( * ) Notice: Subject to any disclaimer, the term of this patent is extended or adjusted under 35 U.S.C. 154(b) by 0 days.

(21) Appl. No.: 09/811,291

(22) Filed: Mar. 16, 2001

(65) Prior Publication Data

US 2001/0046440 A1 Nov. 29, 2001

Related U.S. Application Data

(60) Provisional application No. 60/190,445, filed on Mar. 17, 2000.

(51) Int. Cl.[7] ..... F04W 29/32
(52) U.S. Cl. ..... 416/5; 416/146 R
(58) Field of Search ..... 416/146 R, 229 R, 416/5, 210 R; 362/96

(56) References Cited

U.S. PATENT DOCUMENTS 4,053,123 A * 10/1977 Chadwick ..... 416/114
4,305,292 A * 12/1981 Felter ..... 416/144
6,019,479 A * 2/2000 Barker ..... 416/146 R
6,213,617 B1 * 4/2001 Barker ..... 416/5

* cited by examiner

*Primary Examiner*—Edward K. Look
*Assistant Examiner*—Igor Kershteyn

(57) ABSTRACT

The invention comprises a reflective blade or a reflective blade with a picture which fits over a ceiling fan blade or a mirror cut in the shape of a ceiling fan and used in place of a ceiling fan. The device may be an applique of reflective materials which can be patched over the ceiling fan blades and may have cutouts and peel away edges in varying degrees in order to allow it to fit over the ceiling fan blades of various sizes. Likewise, sets of different size mirrors may be sold for the same purpose.

14 Claims, 5 Drawing Sheets

METHOD FOR DECORATING CEILING FANS

PRIORITY

This patent is a continuation of Provisional Patent: 60/190,445 filed Mar. 17, 2000.

BACKGROUND OF INVENTION

1. Field of Invention

The invention applies to ceiling fans and mirrors. More particularly, the invention applies to ceiling fan blades which are mirrors or are equipped with mirrors to provide various effects.

2. Prior Art

Ceiling fans are well known in the prior art. Mirrors are also known in the prior art.

GENERAL DISCUSSION OF INVENTION

The invention comprises a reflective blade or a reflective blade with a picture which fits over a ceiling fan blade or a mirror cut in the shape of a ceiling fan and used in place of a ceiling fan.

The device may be an applique of reflective materials which can be patched over the ceiling fan blades and may have cutouts and peel away edges in varying degrees in order to allow it to fit over the ceiling fan blades of various sizes. Likewise, sets of different size mirrors may be sold for the same purpose.

Shapes may be removed from the applique in order to modify the appearance of the mirrors while running or while still.

One purpose of the invention to provide a decorative reflective surface showing the room below as the light spins.

Another purpose is to increase the efficiency of the light by having a reflective surface above the light source and on the ceiling or on the fan blades themselves.

Another purpose is to provide with a ceiling fan a novel light effect associated with the ceiling fan light or an alternative light source reflecting off of the shaped or unshaped mirrored surfaces of the fan blades.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figure 1:
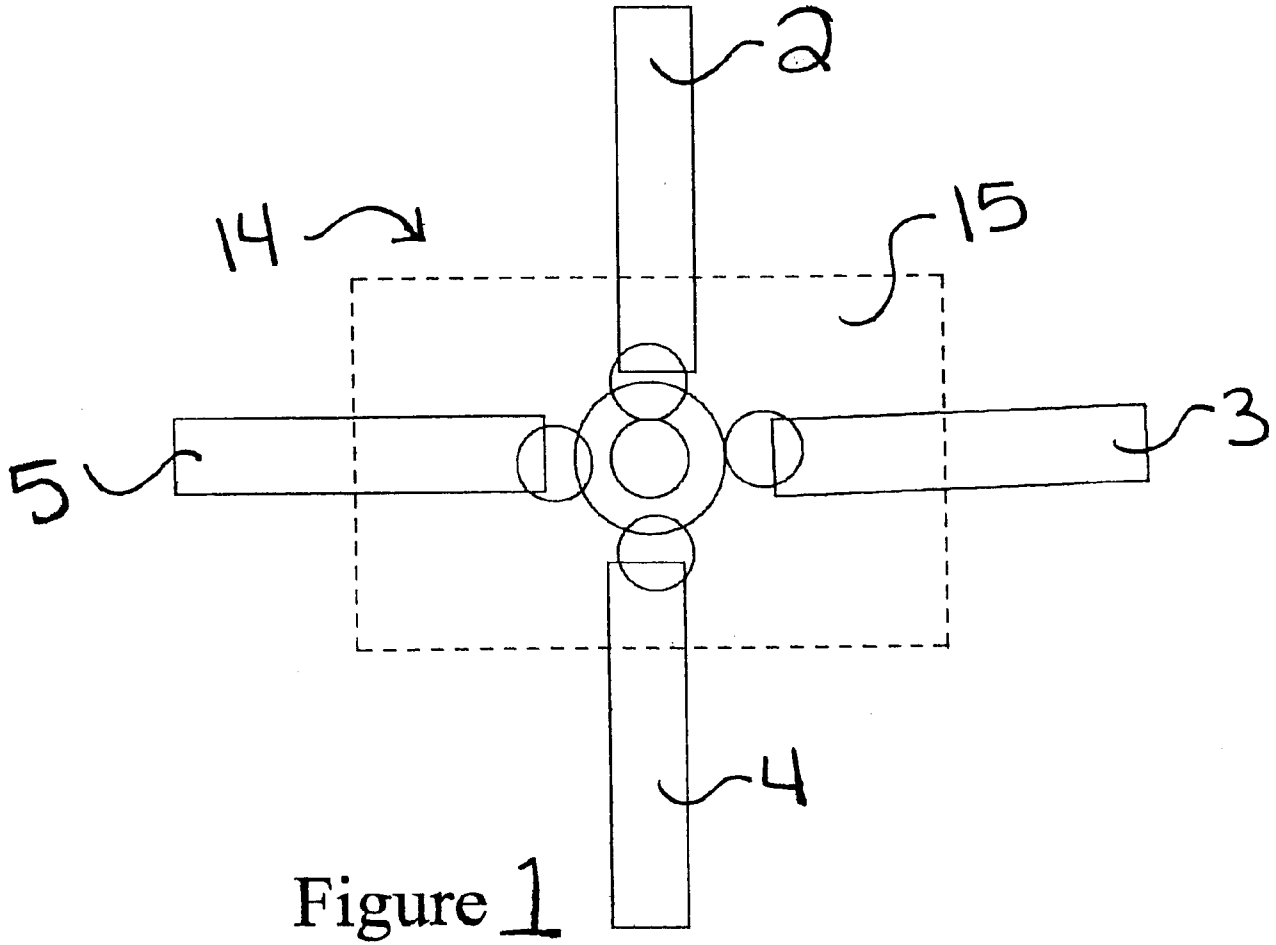
FIG. 1 shows a view from the floor of a ceiling fan with a pattern on the ceiling.

As can best be seen by reference to FIG. 1 a fan comprises fan blades 2–4 attached to a motor 16 by way of pivoting brackets 17 which allow the angle of the blades 2–4 to be adjusted.

Figure 5:
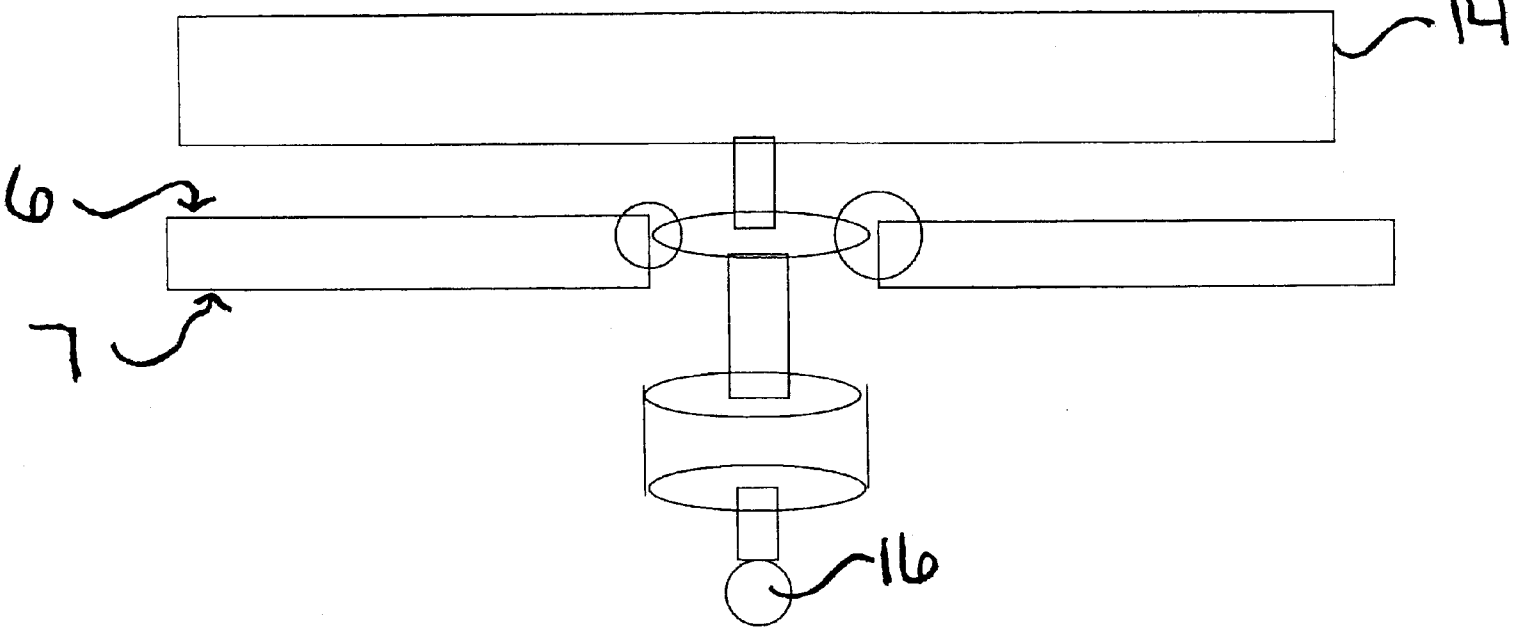
FIG. 5 shows a side view of the invention with a ceiling fan.
Figure 5B:
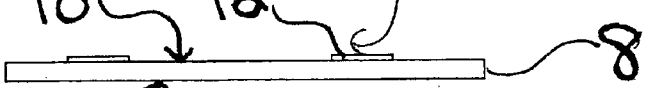
FIG. 5*b* shows a side view of an alternative strip.

As shown in FIG. 5, the blades may be modified by attaching a peel off decoration for use with the ceiling fan 1 is disclosed having ceiling fan blades 2, 3, 4 and 5 having a top 6 and bottom 7. A light 18 may be in place below these ceiling fans 1. The light 18 may also, in some circumstances, be found above the ceiling fan blades 2–5 as disclosed in this invention.

The invention comprises at least one mirror 8 attachable to the bottom 7 of one or more of the blades 2–5. The mirror 8 is shown in FIG. 5 as an applied mirror having a tape 12 on top which tape may be protected by a peel off cover 13. Alternatively, the entire blade may be a mirror 8 so that the mirror actually replaces the blades to obtain the desired effect.

Figure 3:
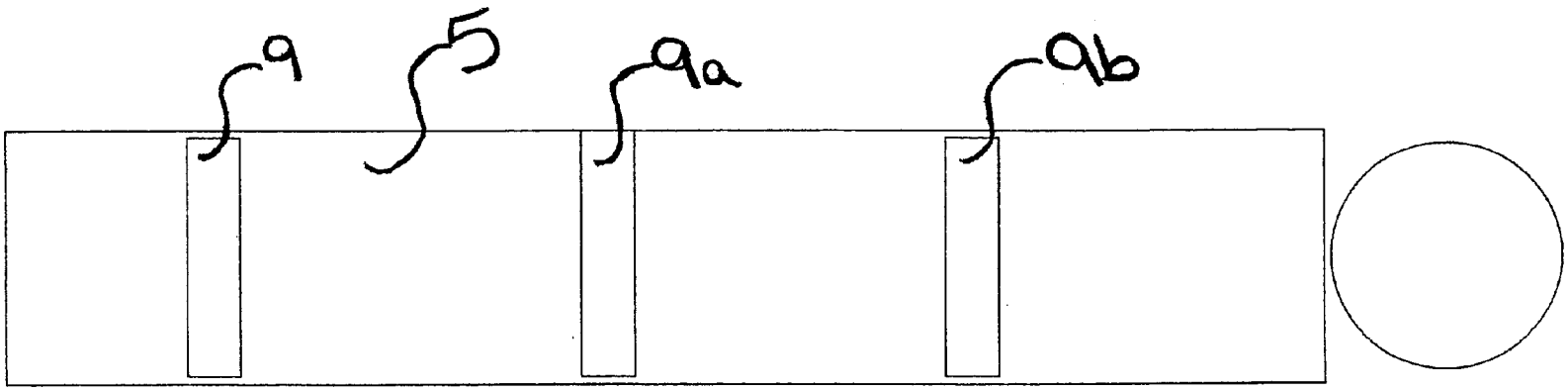
FIG. 3 shows a view of a mirrored ceiling fan using patterned mirrors.
Figure 2:
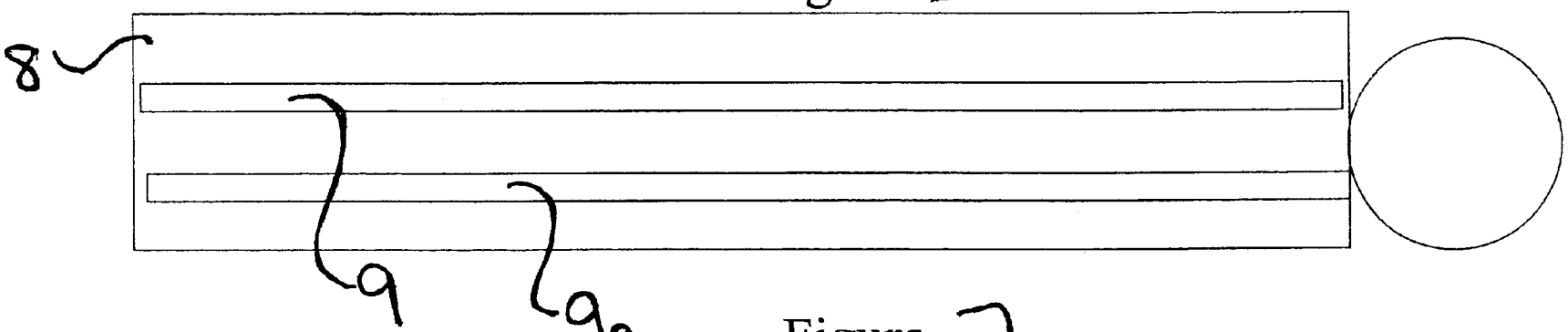
FIG. 2 shows a view of a first patterned mirrored ceiling fan blade.
Figure 4:
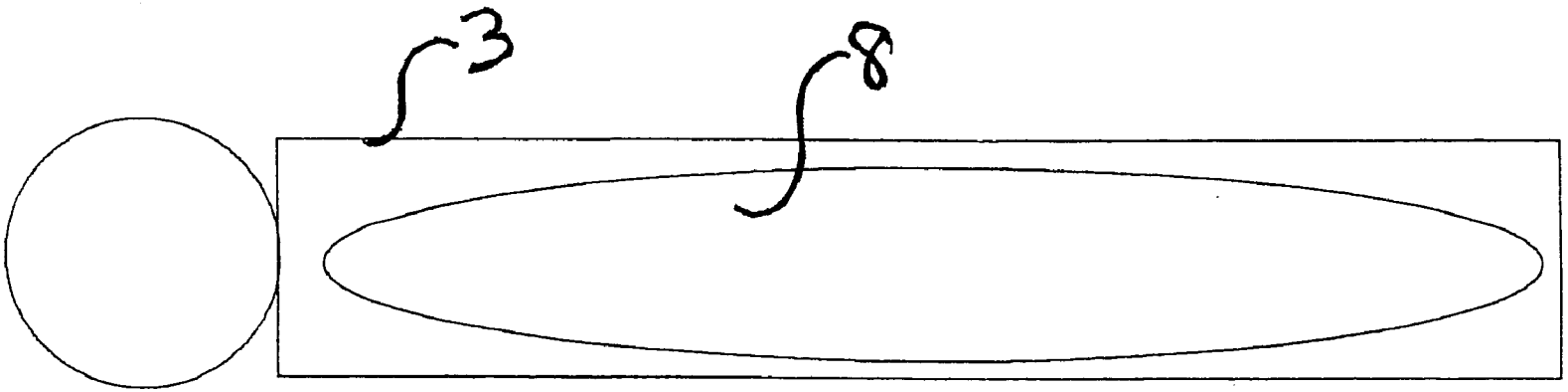
FIG. 4 shows a different shaped mirror pattern.

FIG. 4 shows where an oval mirror 8 is attached to a square fan blade 3 to obtain a desired effect. This is one example of how a design or pattern, here an oval, may be present on blades which do not have mirrors or may be made using mirror material for displaying at least one pattern against or interspersed with the mirror when the ceiling blades are still or while the ceiling fans are in motion. The design and mirror shapes may be made to shows different designs or visual effects depending upon the speed of the ceiling fan so that at least two different patterns may be displayed. The design may be created by strips of mirrored material as shown in FIGS. 2 and 3 where strips 9, 9*a* and 9*b* may be made of mirrored or non-mirrored material. In addition, the strips may be placed over the mirror 8 and made of a different mirror material or non-mirror material as shown in FIG. 2 or FIG. 3.

The mirror may be designed or may have upon it a pattern 9 or there may be a pattern 15 attachable to the ceiling 14 above the ceiling fan 1 which interacts with the mirrors 8 or pattern 9 on the ceiling fan blades 2–5. The invention of the mirror further comprises a mirrored side 11 and an attachment side 10 and wherein the attachment side 10 is attachable to the ceiling blades bottom 7. The attachment side 10 may have an attachment glue means 12. This may be double sided tape 12 having a cover 13 which may be peeled away to attach the mirror 8 to the fan blade.

The mirror 8 may have the same shape as the ceiling fan blade 2–4. The mirror 8 may be made of flexible material.

The mirror may be made of cuttable material so that the user may be custom cut. The mirror may be pre-cut with cuts or markings 16 so that it may be peeled, cut or torn to correspond to the shapes of various standardized ceiling fan blades sizes. The mirror may be, alternatively, an integral part of the ceiling fan blade.

The invention may be practiced with a plurality of mirrors as the pattern 9. The patterns which may be colors, photographs, pictures or mirrors may have various shapes. The mirrors may also have one or more colors. The colors, photographs, pictures or mirrors may be arranged to provide one or more effects as the fan blades spin. The mirror may cover less then the entire fan blade to given a desired effect.

Where the mirror covers less than the entire fan blade a pattern may be used which is attachable to the remainder of the fan. The design created by the mirrored and non-mirrored shapes on the ceiling fan blade may create different effects depending upon the speed with which the fan operates.

As can be seen in the preferred embodiment, a bulb 18 may be below the fan blades 2–5 in order to provide lighting to the mirrors 8. This is one additional method whereby the mirrors and/or pattern functions in conjunction with the movement of the fan.

The ceiling fan blades are typically at an angle and this angle may be varied to provide differing effects.

Figure 6:
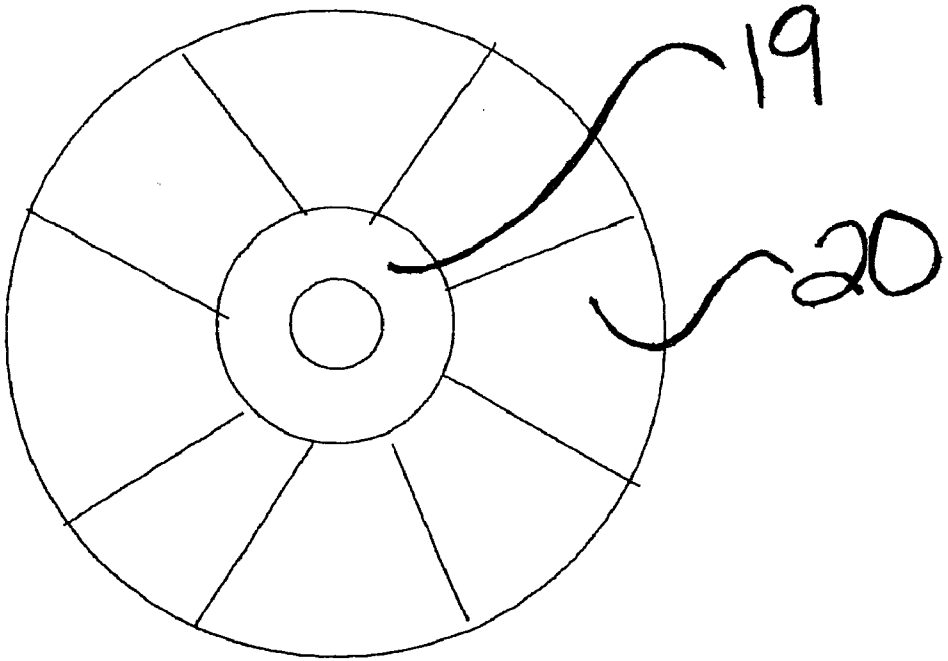
FIG. 6 shows an alternative embodiment for the invention.

FIG. 6 shows a modification of the arrangement where a ring 19 which may be mounted below the fan blades 2–5, may carry shaped surfaces 20 to further the effects caused by the mirrored surfaces on the ceiling fan blades. These surfaces 20 may be below the light 18 so as to reflect the light upward towards the ceiling fan blades with the mirrored surfaces.

Figure 5A:
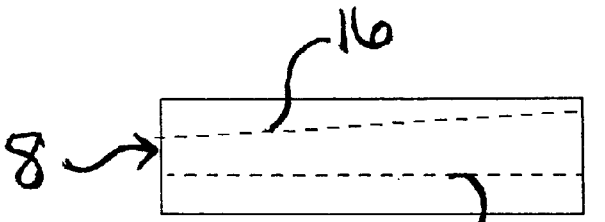
FIG. 5*a* shows a top view of a strip.

FIG. 5*a* shows a potential mirror 8 which may have pre-cut sections 21–24 separated by pre-cut section lines 25 so that the size of the mirror 8 may be changed to fit a pre-determined pattern or a pre-determined blade size to allow for the mirror to be sized and shaped to be attached to a particular ceiling fan blade.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What is claimed is:

1. A decoration for use with a ceiling fan having ceiling fan blades having a top and a bottom comprising:

a) at least one mirror attachable to the bottom of the blades and further comprising a design on the mirror for displaying at least one pattern against the mirror when the ceiling blades are in motion.

2. The invention of claim 1 wherein the design appears different depending upon the speed of the ceiling fan so that at least two different patterns may be displayed for two different fan speeds.

3. The invention of claim 2 wherein the mirror further comprises a mirrored side and an attachment side and wherein the attachment side is attachable to the ceiling fan blades.

4. The invention of claim 3 wherein the attachment side comprises a glue means for holding the mirror to the ceiling fan blades.

5. The invention of claim 2 wherein the mirror is made of cuttable material.

6. The invention of claim 2 wherein the invention further comprises at least one second mirror attachable to the ceiling fan blade, and wherein the mirrors have various shapes.

7. The invention of claim 4 wherein the various shapes are arranged to provide a visual effect.

8. A decoration for use with a ceiling fan having ceiling fan blades having a top and a bottom comprising:

a) at least one mirror attachable to the bottom of the blades and further comprising a pattern attachable to the ceiling above the ceiling fan which interacts with the pattern on the ceiling fan blades.

9. A decoration for use with a ceiling fan having ceiling fan blades having a top and a bottom comprising:

a) at least one mirror attachable to the bottom of the blades and wherein the mirror has the same shape as the ceiling fan blade.

10. A decoration for use with a ceiling fan having ceiling fan blades having a top and a bottom comprising:

a) at least one mirror attachable to the bottom of the blades and wherein the mirror is made of flexible material.

11. A decoration for use with a ceiling fan having ceiling fan blades having a top and a bottom comprising:

a) at least one mirror attachable to the bottom of the blades and wherein the mirror is comprised of a plurality of pre-cut sections.

12. The decoration of claim 11 wherein the ceiling fan blades are standardized and wherein at least one of the pre-cut sections corresponds in size and shape to the standardized ceiling fan blades.

13. An overlay for fan blades having a length comprising:

(1) at least one strip having a front side and a back side and width and a length corresponding to the length of the fan blades;

(2) a mirrored surface on the front side;

(3) a glued surface on the back side; and wherein the at least one strip is approximately the same size as the fan blade.

14. The overlay of claim 13 wherein the at least one strip further comprises a plurality of peel off edges so that the length and width may be changed by removal of at least one of the plurality of peel off edges.

* * * * *